United States Patent [19]

Matthews et al.

[11] Patent Number: 4,696,375

[45] Date of Patent: Sep. 29, 1987

[54] CHAIN BREAK SAFETY DEVICE

[75] Inventors: Ronald Matthews, Downers Grove; John J. Jecmen, Oak Brook, both of Ill.

[73] Assignee: Harris Preble Company, Chicago, Ill.

[21] Appl. No.: 874,581

[22] Filed: Jun. 16, 1986

[51] Int. Cl.[4] ..... B66B 13/00

[52] U.S. Cl. ..... 187/58; 187/88; 188/189; 49/322

[58] Field of Search ..... 187/58, 85, 86, 88, 187/52, 61; 188/189; 49/322; 254/387

[56] References Cited

U.S. PATENT DOCUMENTS

| | | | |
|---|---|---|---|
| 2,300,630 | 11/1942 | Norton et al. | 49/322 |
| 2,550,839 | 5/1951 | Martin | 187/88 |
| 4,176,826 | 12/1979 | Gray et al. | 188/189 |

FOREIGN PATENT DOCUMENTS 563472 1/1973 U.S.S.R. .

*Primary Examiner*—Joseph J. Rolla
*Assistant Examiner*—Kenneth Noland
*Attorney, Agent, or Firm*—Donald E. Egan

[57] ABSTRACT

A chain break safety device for vertically moving, biparting, counter-balanced elevator doors which comprises a block having a vertical lead disposed tapered opening, said block having limited vertical moveability with respect to the door, a braking member positioned within the tapered opening, a cage for maintaining the braking member in the tapered opening, and a resilient member adapted to deflect under the tension of the counter-balance system and move said block into a non-braking position and to cause the block to move into a braking position upon failure of the counter-balance system, thus pinching the braking member between the tapered surface and a static vertical member of the elevator door system.

15 Claims, 5 Drawing Figures

CHAIN BREAK SAFETY DEVICE

The present invention relates to vertically moving, bi-parting, counter-balanced freight elevator doors and to a safety device which prevents downward movement of the elevator doors in the event of chain breakage or in the event the counter-balancing system should otherwise fail.

Counter-balanced freight elevator doors have been in use for a number of years, see for example U.S. Pat. No. 2,300,630 to Norton et al. Most common are the bi-parted, vertically moving freight elevator doors, wherein the lower door comprises a trucking sill. In such doors counter-balancing systems are usually employed in order to balance the weight of the lower door, which is conventionally equipped with a trucking sill, against the weight of the upper door as they move up and down during the opening and closing of the doors. Less common are other types of freight elevator doors wherein one or more doors are directly coupled to motors and the like, using chains or cables to effect the movement of the doors.

In the counter-balancing systems which are conventionally used, the lower door is attached to the upper door through a chain or cable which rides over a pulley located above the elevator doors. Pairs of doors are constructed so that the upper door weighs approximately the same as the lower door. Consequently, the operation of the doors, in both opening or closing movement, requires relatively little energy other than that necessary to overcome inertia. The easy operation of the doors is thus dependent upon the ability of the counterbalancing system to counter-balance the weights of each door against each other. However, in the event the counterbalancing system should fail, either through the failure of the chain of the counter-balancing system or the connecting cable, the elevator doors, which are frequently quite heavy, may fall, and if not checked, could create serious injury to personnel and property.

Prior art workers have been aware of the foregoing problem and have proposed to provide doors with emergency braking devices. For example, U.S. Pats. Nos. 1,998,233; 2,300,630 and 3,188,698 employ pawls which pivot to apply braking forces to the elevator doors. While such brakes and braking systems are useful, they are relatively expensive and consequently have not been widely used.

The chain break safety device of the present invention is designed to provide an automatically acting, braking device, adapted to engage and stop downward movement of the elevator doors upon failure of the counter-balancing system. It is also contemplated that the chain break safety of the present invention may be used on other types of vertically moving elevator doors which employ a chain, cable, or other flexible means which is held under tension and which is designed to move or maintain the weight of elevator doors. It is the object to provide a safety brake which will engage automatically, quickly and assuredly to prevent the door from moving downward in a vertical directionin the event such flexible means should break or fail.

It is contemplated that the safety device of the present invention will be attached to the side of the elevator door in a position adjacent to a static member of the elevator door system, such as the lintel, which forms a portion of the guides in which the elevator doors move vertically. Upon failure of the counter-balancing system the downward movement of the door will be immediately checked by the brake of the safety device engaging a static member, and stopping the door before the door can fall or begin to fall significantly.

The general concept of the invention, the embodiment which comprises the best mode of carrying out the invention and the various features and advantages thereof will be apparent from the following description and the appended claims.

Figure 5:
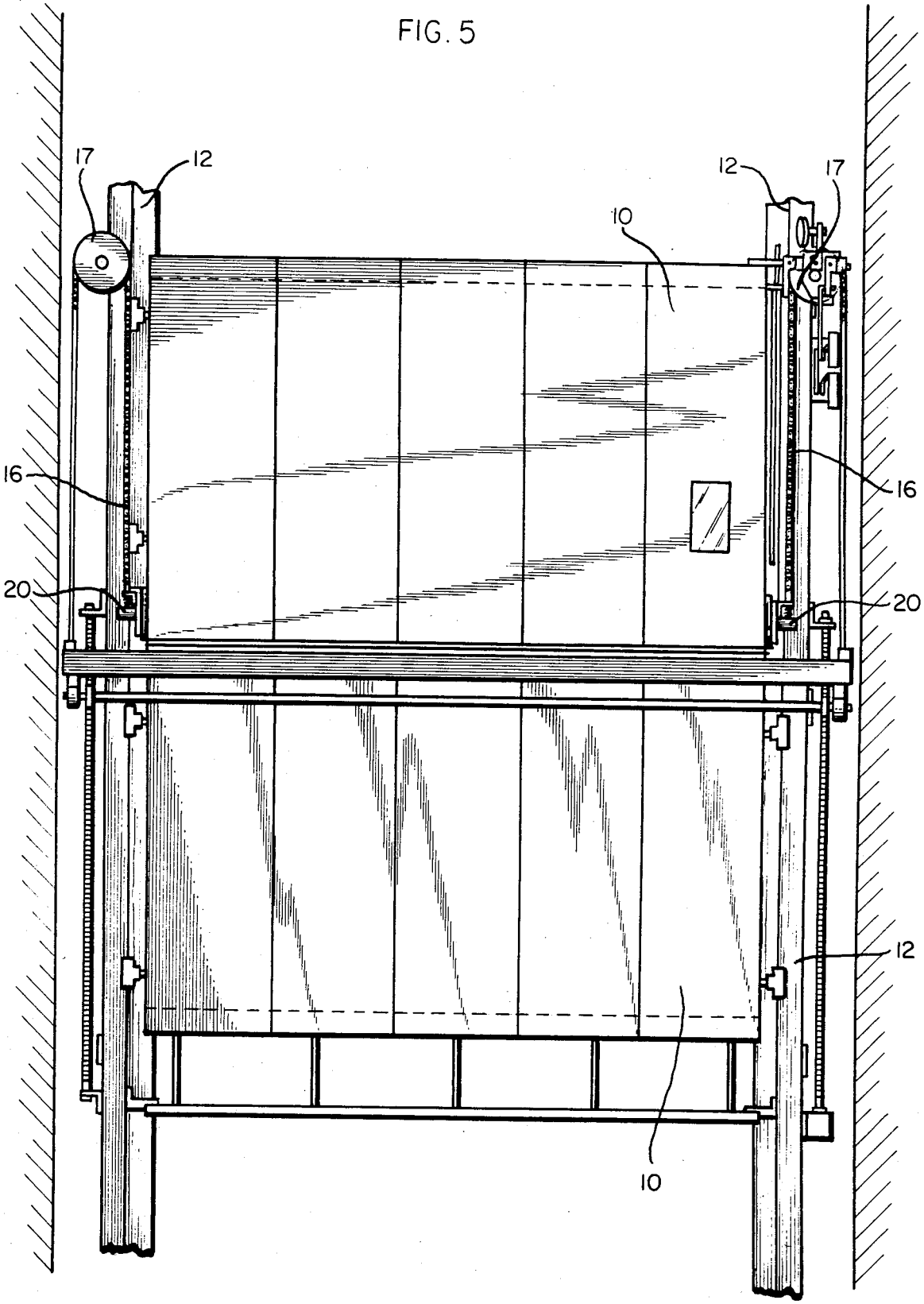
FIG. 5 is a front view of a counter-balanced freight elevator door system (taken from the elevator car side) showing safety devices of the present invention installed on both sides of the top door.

Referring to the drawings in detail, the chain break safety device 20 of the present invention is illustrated in its intended environment, in connection with a vertically sliding freight elevator door 10 of conventional construction. Door 10 is designed to move vertically and to engage guide track 12 with rollers (not shown). The door 10 is usually one of a pair of doors which operate in association with a counter-balancing system shown more fully in FIG. 5. The lowermost portion of the counter-balance system, affixed to upper door 10, is chain 16. The counter-balance system supports the weight of the elevator door by balancing it against the opposite door, using a pair of chains or cables 16 which ride over a pair of pullies 17 located above the elevator door. The weight of the doors is thus supported by the chain 16 which is under tension. A counter-balance system of conventional design is shown in FIG. 5, but other types of counter-balance systems are contemplated by the present invention.

The safety device of the present invention is shown generally at 20. It comprises block 30, brake member 40, cage 50 for said brake member 40 and a resilient means 60.

Block 30 must be attached to door 10 in a manner that provides limited vertical moveability or slideability with respect to door 10. It is preferred that the block be mounted on the side of the door, although other mounting positions may be used. Block 30 includes a tapered opening 32 which is defined by vertical surface 34 and tapered surface 36. Preferably vertical surface 34 is a continuous smooth vertical surface, although the shape, size and configuration is not critical. Tapered surface 36 is preferably a smooth hardened surface which is continuous in nature. The slope of the taper may be varied over wide limits, but a taper of between 8 and 20 degrees, as is shown in the drawings, is preferred. It is essential that surfaces 34 and 36 combine to form tapered opening 32 with its wider end at the lowermost end. Block 30 is preferably a casting, but it may be fabricated by other means.

Figure 2:
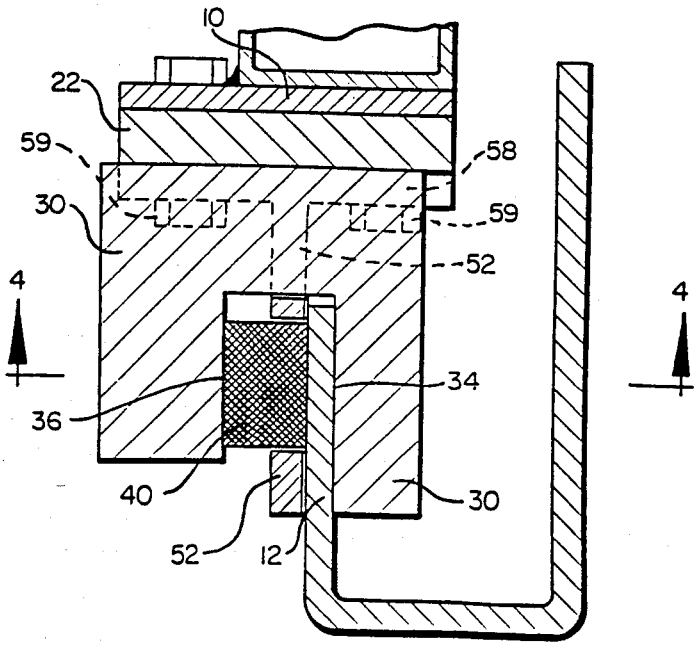
FIG. 2 is a top view, taken in section along lines 2—2 of FIG. 1.
Figure 3:
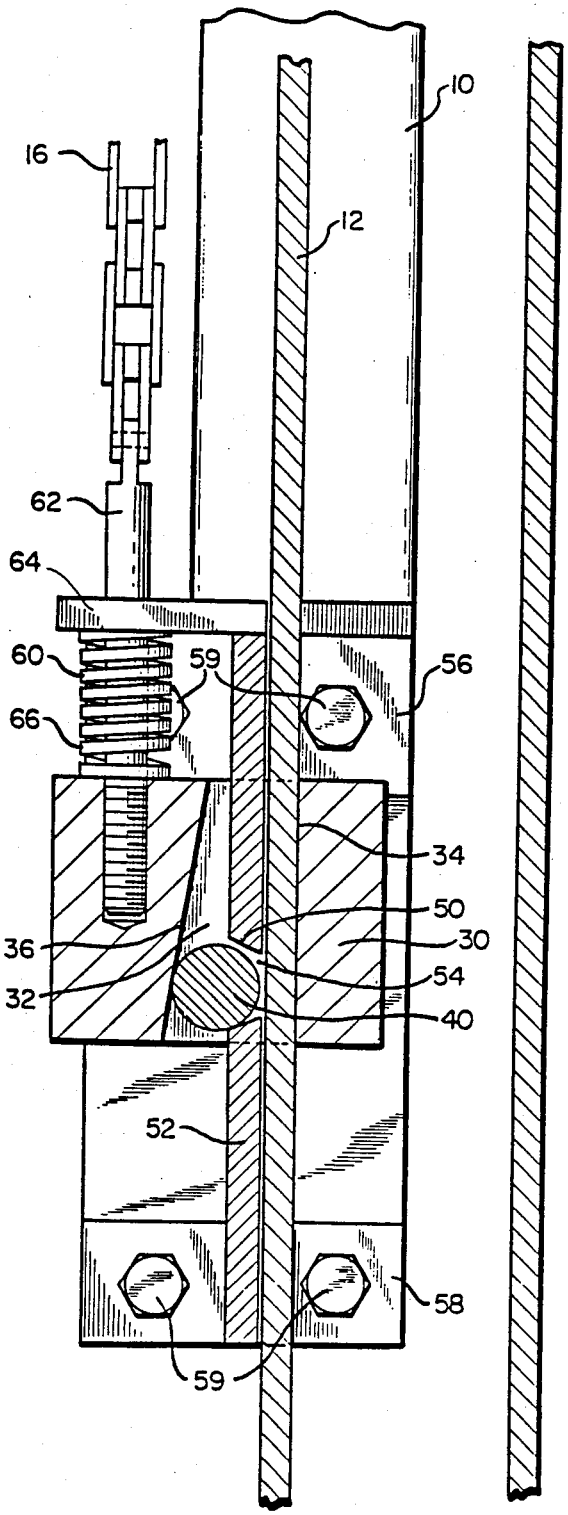
FIG. 3 is a side view taken, in section along lines 4—4 of FIG. 2, showing the safety device in the non-braking position.
Figure 4:
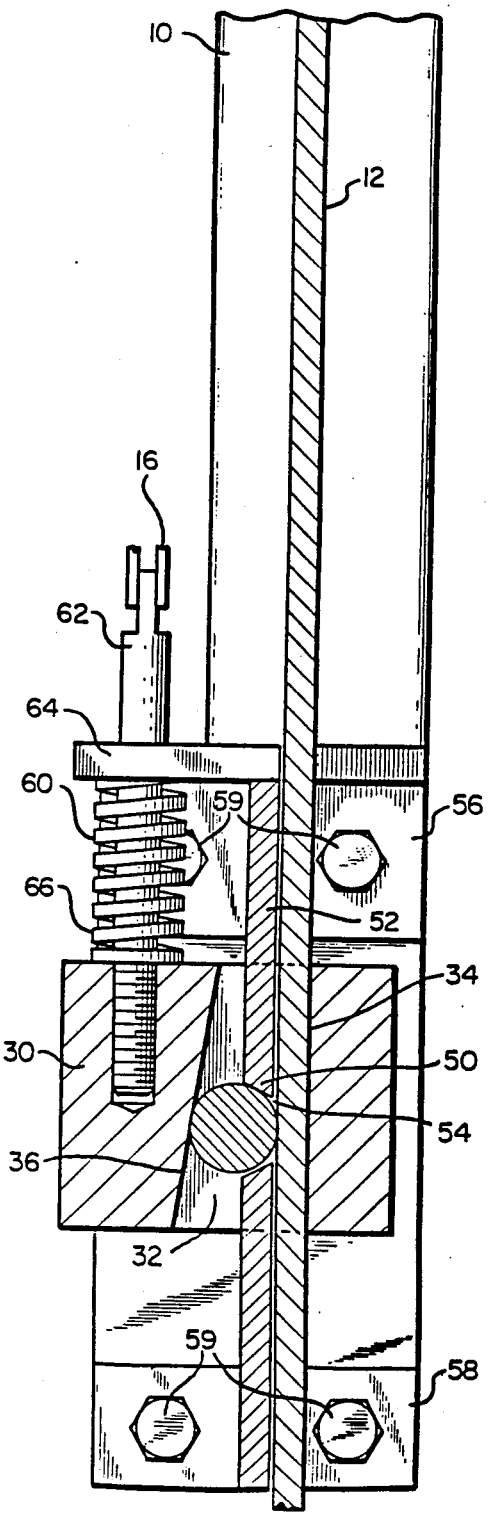
FIG. 4 is a side view, taken in section along lines 4—4 of FIG. 2, showing the safety device in the braking position.

Block 30, which is attached to door 10, must be positioned adjacent to a static member of the elevator door operating system such as a lintel or guide track 12, whereby said static member protrudes into the tapered opening 32. As can be clearly seen from FIG. 2, guide track 12 preferably extends into tapered opening 32 and wherein track 12 is positioned between tapered surface 36 and vertical surface 34.

Brake member 40 is also positioned within said tapered opening 32, between track 12 and tapered surface 36. The brake member 40 must be sized so that it can move freely between track 12 and the tapered surface 36 in the wider end of the tapered opening 32, but so that it will contact track 12 and tapered surface 36 near the narrower end of the tapered opening 22. The braking member 40 shown in the drawings is a small roller, the diameter of which is small enough to allow the roller to be positioned in the lower, wider end of the tapered opening 32 without touching either tapered surface 36 or track 12. However, when the roller is moved upwardly in the tapered opening, toward the narrow end of the tapered opening, it contacts tapered surface 36 and track 12. As the braking member is moved further towards the narrow end of the tapered opening, the compression between tapered surface 36 and track 12 increases, thus pinching braking member 40 between tapered surface 36 and track 12 and producing increasingly greater braking forces. In the preferred embodiment, the brake member 40 is a small roller which may be comprised of hardened steel with a plain or knurled surface. Alternatively, the brake member may be a relatively soft material, i.e., unhardened steel or a synthetic resin composition, such as are used in automotive brake shoes. The present invention contemplates a variety of shapes for brake member 40.

Brake member 40 is maintained in position within tapered opening 32 and adjacent to the door 10 by cage 50. In the preferred embodiment, cage 50 is comprised of plate 52 having a rectangular opening 54 therein, which opening comprises the cage. Plate 52 extends into tapered opening 32 and thus serves as a track upon which block 30 slides vertically while maintaining block 30 in position adjacent to door 10. Flanges 56 and 58 serve to connect plate 52 and the braking device 20 to door 10 by bolts 59.

Block 30 is connected to the chain 16 of the counterbalance system through the resilient means shown generally at 60. The resilient means 60, in the preferred embodiment comprises vertically disposed pin 62, which may be threadedly engaged in block 30. Pin 62 is affixed, at its upper end, to chain 16 of the counterbalancing system. Pin 62 extends vertically through horizontal plate 64 which is secured to the elevator door and preferably to plate 52 as by welding or the like and to maintain plate 64 in a horizontal attitude.

Pin 62 serves as a guide for resilient member 66. Preferably resilient member 66 is a coil spring adapted to be deflected by the tension provided by the door counterbalancing system. In the operation of the preferred embodiment of the present invention, the tension of the counter-balance system applied through chain 16 comprises resilient member 64, and block 30 moves upward in a vertical direction as constrained by plate 52 and as guided by pin 60. As block 30 moves upward, the braking member 40, which is retained by cage 50, is released from the pressure of the tapered opening 32. When brake member 40 is released from the confining pressure of tapered opening 32, it no longer contacts both tapered surface 36 and track 12, but it "floats" in a manner that permits it to freely move up and down along guide track 12 without causing any braking action and without causing any drag against the guide track 12 as the door 10 moves vertically.

However, in the event that chain 16 should break or the counter-balancing system should otherwise fail in any manner, the tension on chain 16 would be removed, and deflected resilient member 66 would recover and push block 30 downwardly, thus pinching brake member 40 in the smaller end of tapered opening 32 and thus causing brake member 40 to be compressed between tapered surface 36 and door guide track 12. The compression or pinching of braking member 40 between the moving tapered surface 36 and the static guide track 12 provides a frictional force of increasing intensity which quickly, and automatically stops the downward motion of the door before any significant downward velocity is attained.

If desired, the chain break safety 20 of the present invention may be affixed to mounting plate 22 which is then bolted to door 10. In this embodiment, block 30 is retained between plate 22 and plate 52 which is convenient for installation, shipping and handling. Alternatively, the chain break safety device of the present invention may be mounted directly on door 10 or one of the door frame members without the need for a mounting plate.

Figure 1:
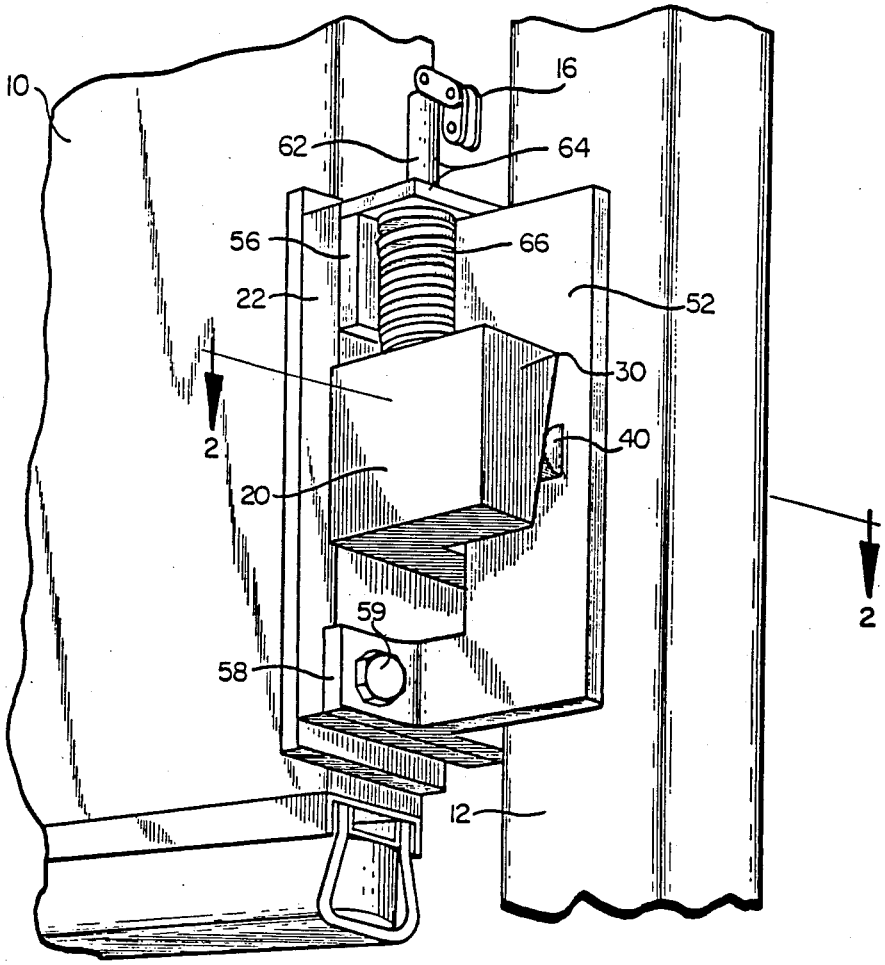
FIG. 1 is an isometric view of the safety device secured to an elevator door.

Although the FIGS. 1 and 5 show the chain break safety devices 20 at the lowermost portion of the upper door 10, the chain break safety 20 may be mounted at any position along the edge of the door and may be designed to accomplish the braking action in cooperation with any static member of the elevator door system. Those skilled in the art will understand that a single safety device of the present invention may be used for one or more of the doors in a counter-balanced system. In some systems only the upper door needs to be filled with a chain break safety device. It is generally preferred that a pair of chain break safety devices should be mounted on each door. Thus each pair of elevator doors would normally be fitted with four chain break safety devices.

Although the chain break safety device of the present invention has been designed primarily for use with vertical, bi-parting, counter-balanced elevator doors, those skilled in the art will understand that other applications are contemplated. For example, the safety device of the present invention may be used with any vertically operating door system wherein the door is moved by or suspended from a member or a pair of members under tension, e.g., a chain or cable. Although the present invention has been called a chain break safety device, the present invention may be used with cables, wires or the like which are under tension.

The forms of invention herein shown and described are to be considered only as illustrative. It will be apparent to those skilled in the art that numerous modifications may be made therein without departure from the spirit of the invention or the scope of the appended claims.

What is claimed is:

1. A chain break safety device adapted for use with a vertically moving, bi-parting, counter-balanced elevator door system, said device adapted to be attached to an elevator door, said chain break safety device comprising:

a block having a vertically-disposed, tapered opening therein, said tapered opening defined by a vertical surface and a tapered surface, said opening having a wider portion and a narrower portion, said tapered opening being oriented with its wider portion disposed downwardly, said opening adapted to slideably engage a static vertical frame member of said elevator door system, said block having limited vertical moveability with respect to said door;

a braking member positioned within said tapered opening, between said tapered surface and said static vertical frame member, said braking member dimensioned to fit loosely within the wider portion of said tapered opening, but dimensioned to be pinched in the narrower portion of said tapered opening, wherein a cage comprises a vertically disposed plate having an opening therein to surround said braking member;

said cage maintains said braking member within said tapered opening;

means to connect said block to said counter-balance mechanism of said elevator door system;

a resilient member, adapted to be deflected by tension of said counter-balance system, whereby said deflection causes said block to move upwardly with respect to said door, thus positioning said braking member in the wider portion of said tapered opening, but upon removal of said tension, said resilient member adapted to recover from its deflected position and cause said block to slide downwardly, positioning said braking member in the narrower portion of said tapered opening and pinching said braking member between said tapered surface and said static vertical frame member.

2. A chain break safety device as described in claim 1, wherein said tapered opening has an inclination of about 15 degrees.

3. A chain break safety device as described in claim 1 wherein said braking member is cylindrical.

4. A chain break safety device as described in claim 3 wherein said braking member is composed of steel.

5. A chain break safety device as described in claim 3 wherein said braking member is composed of a synthetic resin composition.

6. A chain break safety device as described in claim 1 wherein said resilient member is a coil spring.

7. A chain break safety device as described in claim 1 wherein said plate is positioned within said tapered opening.

8. An elevator door system comprising a pair of vertically moving, bi-parting, counter-balanced elevator doors:

said counter-balance system comprising flexible members wherein each door is supported at both ends by a flexible member which is connected to the corresponding end of the other door;

a safety device associated with at least one of said doors, said safety device comprising:

a block having a vertically-disposed, tapered opening therein, said tapered opening defined by a vertical surface and a tapered surface, said opening having a wider portion and a narrower portion, said tapered opening being oriented with its wider portion disposed downwardly, said opening adapted to slideably engage a static vertical frame member of said elevator door system, said block having limited vertical moveability with respect to said door;

a braking member positioned within said tapered opening, between said tapered surface and said static vertical frame member, said braking member dimensioned to fit loosely within the wider portion of said tapered opening, but dimensioned to be pinched in the narrower portion of said tapered opening;

a cage for maintaining said braking member within said tapered opening, wherein said cage comprises a vertically disposed plate having an opening therein to surround said braking member; and a resilient member, connected to said flexible member, said resilient member adapted to be deflected by tension of said counter-balance system, whereby said deflection causes said block to move upwardly with respect to said door, thus positioning said braking member in the wider portion of said tapered opening, but upon removal of said tension, said resilient member adapted to recover from its deflected position and cause said block to slide downwardly, positioning said braking member in the narrower portion of said tapered opening and pinching said braking member between said tapered surface and said static vertical frame member.

9. An elevator door system as described in claim 8, wherein the upper door is equipped with a safety device on both ends.

10. An elevator door system as described in claim 8, wherein each door is equipped with at least one safety device.

11. An elevator door system as described in claim 8, wherein said braking member is cylindrical.

12. An elevator door system as described in claim 11, wherein said braking member is composed of steel.

13. An elevator door system as described in claim 11, wherein said braking member is composed of a synthetic resin composition.

14. An elevator door system as described in claim 8, wherein said resilient member is a coil spring.

15. An elevator door system as described in claim 8, wherein said plate is positioned within said tapered opening.

* * * * *